US009872116B2

(12) United States Patent
Qutub et al.

(10) Patent No.: US 9,872,116 B2
(45) Date of Patent: Jan. 16, 2018

(54) APPARATUS AND METHOD FOR DETECTING EARPHONE REMOVAL AND INSERTION

(71) Applicant: KNOWLES ELECTRONICS, LLC, Itasca, IL (US)

(72) Inventors: Sarmad Qutub, Des Plaines, IL (US); William A. Ryan, Villa Park, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 14/946,282

(22) Filed: Nov. 19, 2015

(65) Prior Publication Data

US 2016/0150335 A1 May 26, 2016

Related U.S. Application Data

(60) Provisional application No. 62/083,530, filed on Nov. 24, 2014.

(51) Int. Cl.

| | |
|---|---|
| ***H04R 29/00*** | (2006.01) |
| ***H04R 1/10*** | (2006.01) |
| *H04R 11/02* | (2006.01) |

(52) U.S. Cl.

CPC ..... *H04R 29/001* (2013.01); *H04R 1/1041* (2013.01); *H04R 11/02* (2013.01); *H04R 2460/03* (2013.01)

(58) Field of Classification Search

CPC ..... H04R 29/001; H04R 1/1041; H04R 3/04; H04R 2430/01; H04R 3/12; H04R 1/10

USPC ..... 381/59, 309

See application file for complete search history.

(56) References Cited

U.S. PATENT DOCUMENTS

| | | | |
|---|---|---|---|
| 5,490,220 | A | 2/1996 | Loeppert |
| 5,870,482 | A | 2/1999 | Loeppert |
| 6,535,460 | B2 | 3/2003 | Loeppert |
| 6,847,090 | B2 | 1/2005 | Loeppert |
| 6,987,859 | B2 | 1/2006 | Loeppert |
| 7,023,066 | B2 | 4/2006 | Lee |
| 7,132,307 | B2 | 11/2006 | Wang |
| 8,072,010 | B2 | 12/2011 | Lutz |
| 9,107,008 | B2 | 8/2015 | Leitner |

(Continued)

FOREIGN PATENT DOCUMENTS

| | | |
|---|---|---|
| EP | 1310136 | 3/2006 |
| EP | 1469701 | 4/2008 |

(Continued)

OTHER PUBLICATIONS

International Search Report and Written Opinion for PCT/US2015/061871 dated Mar. 29, 2016 (11 pages).

*Primary Examiner* — Van D Huynh

(74) *Attorney, Agent, or Firm* — Foley & Lardner LLP

(57) ABSTRACT

At least one electrical value for a plurality of frequencies is measured over a range of frequencies. An impedance is calculated based upon the at least one electrical value for each of the plurality of frequencies in the frequency range, the calculating producing a plurality of impedances. A maximum impedance from the plurality of impedances and a frequency associated with the maximum impedance are determined. The frequency is compared to a predetermined threshold, and based upon the comparing it is determined whether an earphone has been removed from the ear of a wearer.

20 Claims, 3 Drawing Sheets

(56) References Cited

U.S. PATENT DOCUMENTS

2006/0029234 A1* 2/2006 Sargaison ..... H04M 1/6058 381/74
2007/0297634 A1* 12/2007 Hansson ..... H04M 1/6058 381/384
2010/0128887 A1* 5/2010 Lee ..... H04R 1/1041 381/74
2010/0189269 A1* 7/2010 Haartsen ..... H04R 1/10 381/56
2010/0270631 A1 10/2010 Renner
2011/0235817 A1* 9/2011 Lin ..... H04R 1/1041 381/74
2012/0056282 A1 3/2012 VanLippen
2012/0099753 A1 4/2012 vanderAvoort
2013/0028437 A1* 1/2013 Bruss ..... H04R 1/1008 381/74
2013/0142358 A1 6/2013 Schultz
2013/0236027 A1* 9/2013 Tao ..... H04W 52/0241 381/74
2013/0343580 A1 12/2013 Lautenschlager
2013/0345842 A1* 12/2013 Karakaya ..... H04R 5/04 700/94
2014/0233741 A1* 8/2014 Gustaysson ..... H04R 5/04 381/58
2015/0237448 A1 8/2015 Loeppert
2015/0296305 A1 10/2015 Shao
2015/0296306 A1 10/2015 Shao
2015/0365770 A1 12/2015 Lautenschlager
2016/0007119 A1 1/2016 Harrington
2016/0037261 A1 2/2016 Harrington
2016/0037263 A1 2/2016 Pal
2016/0060101 A1 3/2016 Loeppert
2016/0105748 A1 4/2016 Pal

FOREIGN PATENT DOCUMENTS

JP 2012169828 9/2012
JP 5049312 10/2012
KR 1020140026722 3/2014

* cited by examiner

APPARATUS AND METHOD FOR DETECTING EARPHONE REMOVAL AND INSERTION

CROSS-REFERENCE TO RELATED APPLICATION

This patent claims benefit under 35 U.S.C. §119(e) to U.S. Provisional Application No. 62/083,530 entitled "Apparatus and Method for detecting earphone Removal and Insertion" filed Nov. 24, 2014, the content of which is incorporated herein by reference in its entirety.

TECHNICAL FIELD

This application relates to acoustic devices and, more specifically, determining whether these devices have been inserted or removed from the ear.

BACKGROUND OF THE INVENTION

Different types of acoustic devices have been used through the years. Acoustic devices are used in earphones that are inserted entirely or at least partially in the ear. The earphones may include a speaker that presents sound energy to the listener. For example, music may be played to the user. In addition, various other electronic devices may be included with or connected to the earphone such as application processors.

It has become advantageous to determine when an earphone has been removed from (or inserted into) the ear. For example, music may be desired to be played when the earphone is inserted, but not played when it has been removed. This may help to operate the devices more efficiently and save power.

Previous approaches have been either not entirely reliable at properly determining earphone insertion/deletion or have been complicated and/or costly to implement. The problems of previous approaches have resulted in some user dissatisfaction with these previous a.

BRIEF DESCRIPTION OF THE DRAWINGS

For a more complete understanding of the disclosure, reference should be made to the following detailed description and accompanying drawings wherein.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

The present approaches provide for the determination of whether an earphone has been removed (or inserted) from a human ear. The determination of the disposition of the earphone is made automatically without user (listener) intervention. Moreover, the determination utilizes readily available electrical parameters that are readily available or provided at the earphone.

Figure 1:
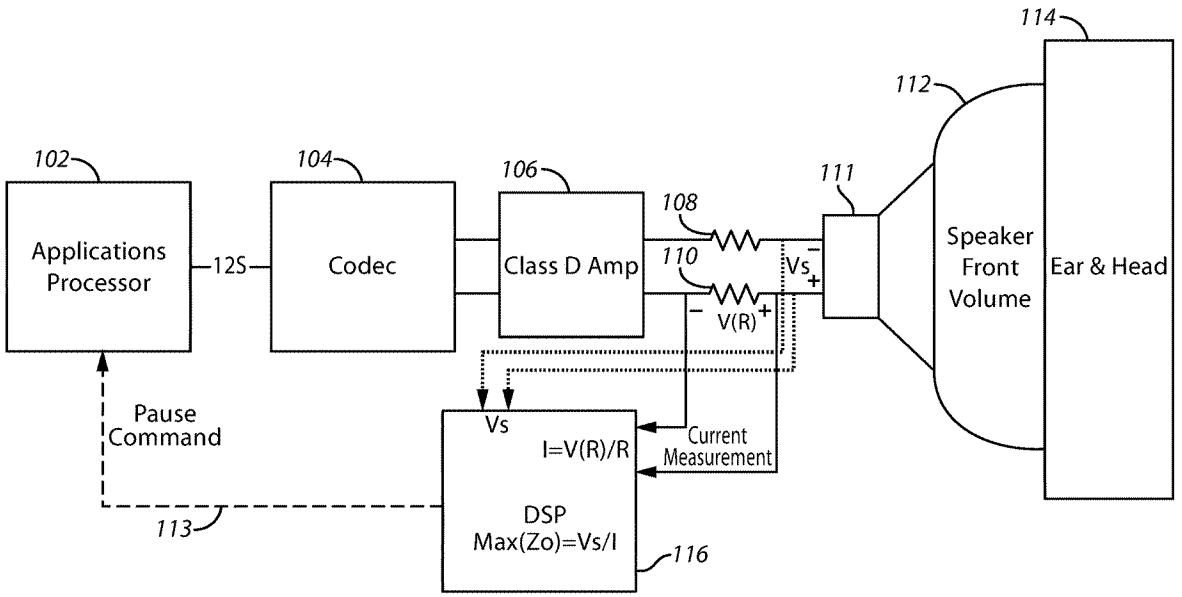
FIG. 1 comprises a block diagram of a system that is configured to determine earphone insertion and/or removal according to various embodiments of the present invention.

Referring now to FIG. 1, one example of a system 100 that determines whether and earphone has been removed (or inserted) into an ear is described. As used herein "earphone" means a device that is inserted in or at last partially in the human ear. In another example, the earphone is disposed over the ear (i.e., it does not extend into the ear canal). In all examples, the earphone presents sound energy to the listener. The system 100 includes an application processor 102, a codec 104 a class D amplifier 106, a first resistor 108, a second resistor 110, a speaker 111 (with a speaker front volume 112). The system 100 is coupled to the ear or head 114 of a listener.

The application processor 102 may provide various applications (e.g., the playing of music) to the listener via the codec 104 and the class D amplifier 106, which transform the digital signals of the application processor 102 into analog signals. In some examples, the class D amplifier 106 may be incorporated with the codec 104. In other examples, the amplifier could be of different topology such as Class AB, Class H, or others The first resistor 108 and second resistor 110 provide a structure by which a current measurement is obtained and provided to the DSP 116. The speaker 111 (having the speaker front volume 112) presents signals from the application processor 102 to the listener. The speaker 111 may be any type of device that converts an electrical signal into sound energy and presents the sound energy to a listener. In one example, the speaker may be an armature-type speaker. In another example, it may be a dynamic speaker. The sound energy to be presented to the listener is created in the speaker front volume 112.

It will be appreciated that an armature-type speaker includes a coil, yoke, magnets, and armature. Excitation of the coil with an electrical signal creates a changing magnetic flux that moves the armature. The armature is coupled to a diaphragm by a drive rod and movement of the armature moves the diaphragm within the front volume 112 to create sound that is presented to the listener.

A dynamic speaker includes a coil, a magnetic circuit, magnets, and a basket with diaphragm mechanically connected to the coil. Excitation of the coil with an electrical signal creates a changing magnetic flux that moves the coil and membrane. The coil moves the diaphragm and coil in unison (mimicking the action of a moving piston), causing sound to be produced. Consequently, movement of the membrane within the front volume 112 creates sound pressure that is presented to the listener.

The DSP 116 is any digital signal processing device that takes the signals received, and determines whether the earphone is removed (or inserted) into the ear based at least in part upon an evaluation of these signals. If the earphone has been removed and in one example, a pause signal 113 may be sent to the application processor 102 to pause the application processor 102 from providing sound energy to the listener.

In one example of the operation of the system 100 of FIG. 1, current and voltage measurements are provided to the DSP 116. These measurements are made across the resistors 108 and 110 and include $V_s$ (across resistor 108) and $V_r$ (across resistor 110). The measurements are also made across a wide frequency range.

An impedance value (Z) is calculated for each of the voltage and current values measured (at a particular frequency). A maximum impedance (Zmax) of all the impedance values measured across frequencies is next determined. From the maximum impedance, a frequency associated with the maximum impedance is determined (Fz)—this is the system resonance. A predetermined resonant frequency of the speaker 111 with an open front volume 112 is known (in other words, the natural resonance of the device is known). Also known is a predefined resonant threshold frequency that represents the system resonance when the speaker is connected to a cavity that is large enough to still be considered an open condition. If the determined frequency is at or below the predefined threshold frequency of the speaker 111, the earphone is open (removed from the ear) and if the determined frequency is above the predefined threshold resonant frequency of the speaker 111, the earphone is closed (inserted in or on the ear).

Figure 3:
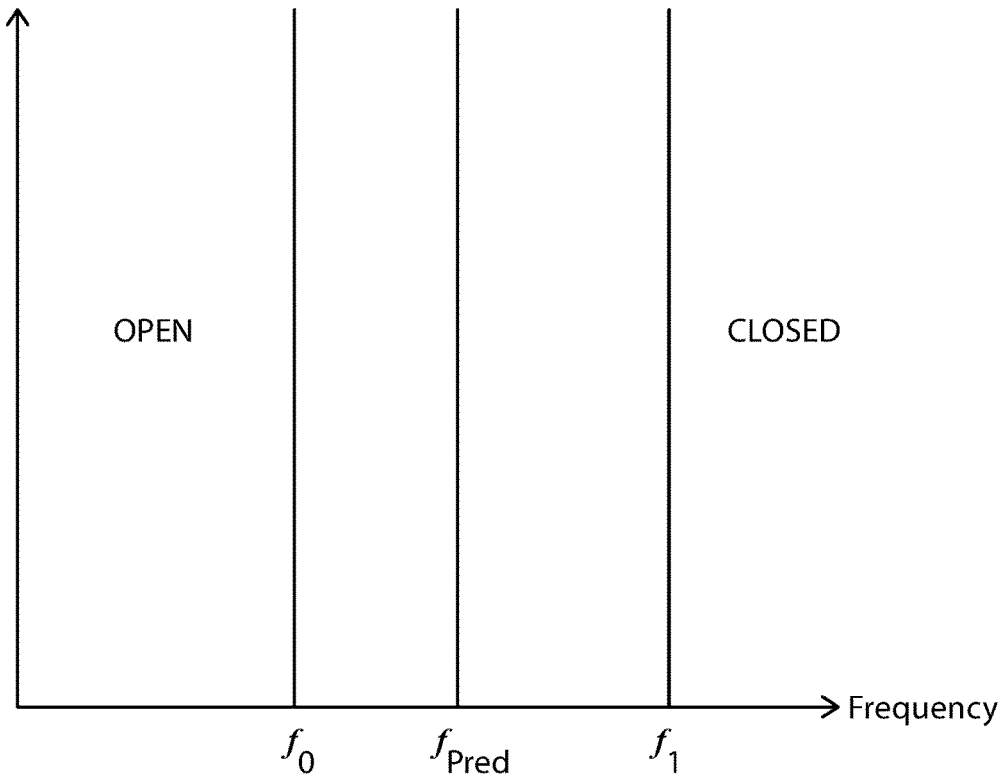
FIG. 3 comprises a graph showing the use of tolerances with the earphone insertion determination according to various embodiments of the present invention.

A tolerance can be used as well to make the determination of whether the earphone is on or in the ear. As shown in FIG. 3, the system resonant frequency fz, can be compared to predetermined frequencies $f_0$ and $f_1$. Tolerances of f0 (for open position) and f1 (for closed position) may be used. For example, if $f_z$ falls below f0, the earphone to be deemed in the open position and above f1 for the earphone to be deemed to be in the closed position.

Based upon this determination, various control signals can be transmitted. In one example, a pause signal 113 may be sent to the application processor 102 to pause the application processor 102 in providing sound to the listener when the earphone is determined to be in the open position. Other commands or mode changes are possible when the earphone is removed from or placed over/in the ear.

Figure 2:
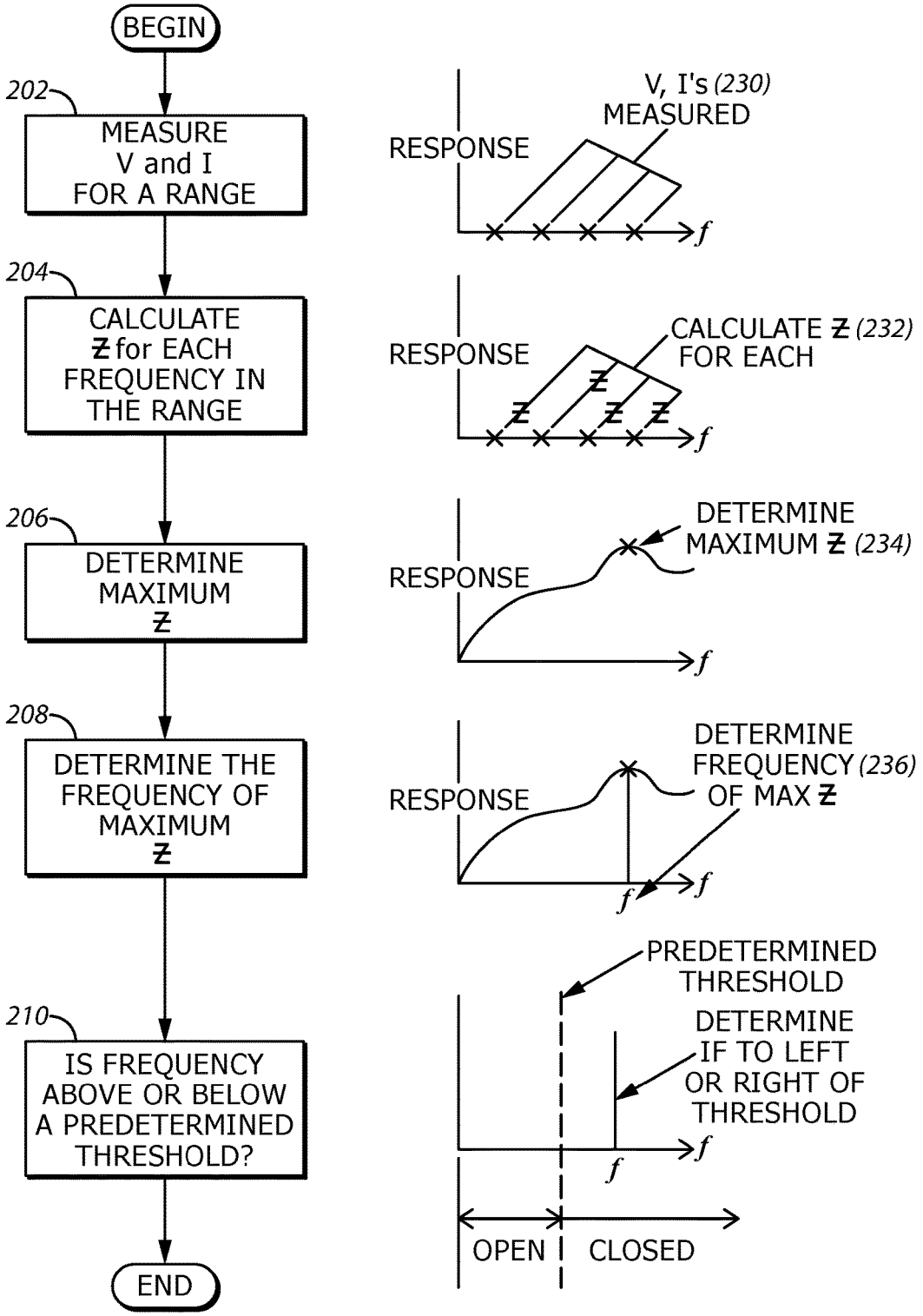
FIG. 2 comprises a flowchart with corresponding graphs describing an approach for determining earphone removal and/or insertion according to various embodiments of the present invention.

Referring now to FIG. 2, one example of for determining earphone removal and/or insertion is described.

At step 202, voltages and currents 230 are measured over a frequency range. For example, the voltage and current at the input of the speaker may be measured for a plurality of frequencies. At step 204 the impedance 232 of each is calculated, for example, using Ohm's law.

At step 206, the maximum impedance 234 is calculated. This may be accomplished, for example, by comparing all the impedance values from step 204, and taking the maximum value.

At step 208, the frequency 236 associated with the maximum impedance is determined. For example, a known response curve of the system may exist and the point on the response curve may be determined. Once this point has been determined, the associated frequency can be determined by examining the frequency (on the y-axis) of the curve At step 210, a determination is made as to whether the frequency determined at step 208 is above or below a predetermined threshold. If the determined frequency $f_z$ is at or below the predetermined resonant frequency of the speaker, the earphone is open (removed from the ear) and if the determined frequency is above the predetermined resonant frequency of the speaker, the earphone is closed (inserted in or placed on the ear). As explained above, tolerances can be associated with making these determinations.

As mentioned above, based upon this determination, various control signals can be transmitted. In one example, a pause signal may be sent to an application processor to pause the application processor in providing sound to the listener when the earphone is determined to be in the open position. Other examples of actions are possible.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A method of determining whether an earphone front volume is occluded and on the ear of a wearer, wherein a speaker of the earphone creates sound energy in the earphone front volume in response to electrical signals, the method comprising:

measuring at least one electrical value of the electrical signals used by the speaker to create the sound energy in the earphone front volume for a plurality of frequencies over a range of frequencies;

calculating an impedance based upon the at least one electrical value for each of the plurality of frequencies in the frequency range, the calculating producing a plurality of impedances;

determining a maximum impedance from the plurality of impedances and a frequency associated with the maximum impedance;

comparing the frequency to a predetermined threshold, and based upon the comparing determining whether the earphone front volume in which the speaker creates sound energy is or is not occluded and whether the earphone has been removed from the ear of a wearer.

2. The method of claim 1, wherein the at least one electrical value comprises at least one current measurement.

3. The method of claim 1, further comprising transmitting a signal to a processor upon detection of removal.

4. The method of claim 1, wherein the at least one electrical value is a current, and the current is measured at the input of the speaker.

5. The method of claim 4, wherein the speaker is a dynamic speaker.

6. The method of claim 1, wherein the at least one electrical value is a current, and the current is measured by determining a voltage change across a resistor in an electrical path between an amplifier and the speaker of the earphone.

7. The method of claim 1, wherein the predetermined threshold is a known resonant frequency of the speaker of the earphone.

8. The method of claim 7, wherein the known resonant frequency is associated with an open condition in which the speaker is known to be connected to a cavity with a volume corresponding to the open condition.

9. The method of claim 1, wherein comparing includes incorporating predetermined frequency tolerances above and below the predetermined threshold.

10. An apparatus for determining whether an earphone has been removed from the ear of a wearer, wherein a speaker of the earphone creates sound energy in a speaker front volume in response to electrical signals, the apparatus comprising:

a measurement device configured to measure at least one electrical value of the electrical signals used by the speaker to create the sound energy in the speaker front volume for a plurality of frequencies over a range of frequencies;

a processing device coupled to the measurement device, the processing device configured to calculate an impedance based upon the at least one electrical value for each of the plurality of frequencies in the frequency range, the calculating producing a plurality of impedances, the processing device configured to determine a maximum impedance from the plurality of impedances and a frequency associated with the maximum impedance, the processing device configured to compare the frequency to a predetermined threshold, and based upon the comparing determining whether the speaker front volume in which the speaker creates sound energy is or is not occluded and whether the earphone has been removed from the ear of the wearer.

11. The apparatus of claim 10, wherein the measurement device comprises at least one resistor.

12. The apparatus of claim 10, wherein the measurement device receives electrical signals from an amplifier.

13. The apparatus of claim 10, wherein the at least one electrical value comprises at least one current measurement.

14. The apparatus of claim 10, wherein the processing device transmits a pause signal to a processor upon detection of removal.

15. The apparatus of claim 10, wherein the at least one electrical value is a current, and the current is measured by the measurement device at the input of the speaker.

16. The apparatus of claim 15, wherein the speaker is a dynamic speaker.

17. The apparatus of claim 10, wherein the measurement device comprises a resistor in an electrical path between an amplifier and the speaker of the earphone, and wherein the at least one electrical value is a current, and the current is measured by determining a voltage change across the resistor.

18. The apparatus of claim 10, wherein the predetermined threshold is a known resonant frequency of the speaker of the earphone.

19. The apparatus of claim 18, wherein the known resonant frequency is associated with an open condition in which the speaker is known to be connected to a cavity with a volume corresponding to the open condition.

20. The apparatus of claim 10, wherein the processing device is configured to compare the frequency to the predetermined threshold by incorporating predetermined frequency tolerances above and below the predetermined threshold.

* * * * *